United States Patent [19]

Chenevert et al.

[11] 4,272,603

[45] Jun. 9, 1981

[54] RESIN BLENDS FOR IMPROVED VESICULAR SYSTEMS

[76] Inventors: Donald J. Chenevert, 1717 Pine Chase, Apt. 87, Houston, Tex. 77055; John R. Grawe, Southern Station, P.O. Box 506, Hattiesburg, Miss. 39401; John C. McDaniel, 4100 Cadillac St., Apt. A, New Orleans, La. 70122

[21] Appl. No.: 92,086

[22] Filed: Nov. 6, 1979

Related U.S. Application Data

[63] Continuation of Ser. No. 803,375, Jun. 3, 1977, abandoned, which is a continuation of Ser. No. 561,799, May 25, 1977, abandoned, which is a continuation-in-part of Ser. No. 306,229, Nov. 13, 1972, abandoned.

[51] Int. Cl.[3] ..... G03C 1/60; G03C 1/76; G03C 1/72

[52] U.S. Cl. ..... 430/155; 430/152; 430/157; 430/176; 430/192; 430/197; 430/271; 430/290; 430/534; 430/535

[58] Field of Search ..... 430/152, 176, 192, 197, 430/290, 271, 157, 155, 165, 167, 534, 535

[56] References Cited

U.S. PATENT DOCUMENTS

| | | | |
|---|---|---|---|
| 3,032,414 | 5/1962 | James et al. | 96/91 R |
| 3,095,388 | 6/1963 | Osmond et al. | 260/4 |
| 3,161,511 | 12/1964 | Parker et al. | 96/49 |
| 3,408,192 | 10/1968 | Aebi | 96/49 |
| 3,485,631 | 11/1969 | Notley | 96/75 |
| 3,498,786 | 3/1970 | Notley et al. | 96/49 |
| 3,552,965 | 1/1971 | Notley et al. | 96/49 |
| 3,620,743 | 11/1971 | Notley | 96/49 |
| 3,622,335 | 11/1971 | Notley | 96/49 |
| 3,622,336 | 11/1971 | Notley | 96/91 R |
| 3,653,902 | 4/1972 | Notley et al. | 96/49 |
| 3,661,589 | 5/1972 | Notley | 96/91 R |
| 3,708,295 | 1/1973 | Schumacher | 96/36.2 |

*Primary Examiner*—Charles L. Bowers, Jr.
*Attorney, Agent, or Firm*—Cushman, Darby & Cushman

[57] ABSTRACT

A vesicular photographic material comprising a polymeric matrix containing a sensitizer which liberates gas when exposed to light, and a process for manufacture of said material. The polymeric matrix comprises a blend of polymethacrylonitrile homopolymer with another resin selected from the group consisting of vinyl polymers and copolymers; epoxy polymers; and copolymers with polyurethane segments. Improved photometrics, particularly film speed, are realized.

2 Claims, No Drawings

RESIN BLENDS FOR IMPROVED VESICULAR SYSTEMS

This application is a continuation of Ser. No. 803,375, filed June 3, 1977, which is a continuation of Ser. No. 561,799, filed May 25, 1977, now abandoned, which is a continuation-in-part of prior U.S. application Ser. No. 306,229, filed November 13, 1972, now abandoned.

BACKGROND OF THE INVENTION

The present invention is directed to the photographic arts, and more particularly to that field of photography concerned with vesicular photographic materials. Most specifically, the instant invention provides a vesicular photographic material comprising a sensitizer suspended in a resin blend of polymethacrylonitrile and at least one other polymeric material applied to a suitable base, as well as a method for its manufacture.

As is well known in the arts, a photographic material for the preparation of vesicular images generally comprises a thermoplastic resin vehicle in which is dispersed a photosensitive compound (a "sensitizer") which is capable of decomposing to yield a gas when exposed to radiation of appropriate ("actinic") wave lengths. This mixture is usually coated on a suitable support, which can be transparent or opaque, so as to form a photographic material as conventionally defined in the art. Upon imagewise exposure to actinic radiation, e.g. through a superimposed transparency which is desired to be copied, the photosensitive compound dispersed within the vehicle is decomposed in the pattern of the imagewise exposure. Development is accomplished by heating the material to at least the glass transition temperature of the thermoplastic resin vehicle, whereby it is softened sufficiently to allow the photolytically generated gas constrained therein to distend the softened vehicle with the resultant formation of bubbles or vesicles therein. These vesicles are trapped when the material is cooled. They are arranged in a pattern corresponding to the original design copied, and they serve to reflect and refract light, thereby giving rise to a visible image under suitable viewing conditions, similar in appearance to that obtainable by better known photographic processes, e.g., the silver halide process and the like.

Early inventions concerning vesicular photographic materials, for example, as disclosed in British Pat. spec. No. 402,737, were directed to the use of naturally derived gelatin as the thermoplastic resin vehicle. It subsequently proved impossible, however, to base a practical commercial embodiment on gelatin because of its moisture sensitivity and its inadequate mechanical durability, among other disadvantages for many commercial applications.

In light of the above limitations, the thrust in the art was directed to vesicular materials employing a hydrophobic polymer as the thermoplastic vehicle. The lack of mechanical integrity inherent in a hydrophylic gelatin medium was first successfully overcome by the system disclosed by James et al in U.S. Pat. No. 3,032,414, which teaches the use of certain classes of synthetic, water insoluble, non-hydroscopic, non-water swelling thermoplastic polymers as the thermoplastic resin vehicle. Vesicular photographic materials prepared in accord with that method, as well as the many subsequent improvements which followed the original teachings of James et al, are characterized by excellent physical and mechanical properties.

In light of the James et al teachings, subsequent efforts in the art have been directed toward improving the photographic sensitivity of the material by selection of other thermoplastic polymers for the hydrophobic resin vehicle. In particular, Parker et al in U.S. Pat. No. 3,161,511 disclose the use of polymethacrylonitrile as the resin vehicle for vesicular photographic materials. This polymer has proven extremely unique in the art, particularly by providing vesicular materials of relatively high photographic sensitivity. Its practical use for many applications, however, is hampered by several undesirable phyical properties. For one, it shows a tendency to craze or crack, and second, it adheres only with difficulty to the more commonly used photographic substrates. Subsequent to the teachings of Parker et al, improvements in the art have been directed to combining the high speed characteristics of polymethacrylonitrile with other resinous materials which do not exhibit the aforementioned physical limitations of polymethacrylonitrile.

More recent attempts in the art have been directed to the development of copolymeric systems incorporating various monomeric materials which are compatible with and copolymerisable with methacrylonitrile, for example, as disclosed in U.S. Pat. No. 3,622,336. While such vesicular materials exhibit improved physical properties in comparison to the methacrylonitrile homopolymer, the resulting copolymeric materials do not demonstrate the highly efficient gas utilization of the methacrylonitrile homopolymer. Another distinct problem with some of these copolymeric systems is their relative incompatibility with methacrylonitrile homopolymer. This art recognized incompatibility of methacrylonitrile homopolymer and mixtures with other resins known to be useful in the preparation of vesicular films as discussed at length in U.S. Pat. No. 3,661,589 to Notley. However, it has been found that interfacial prints prepared in accord with the Notley disclosure exhibit an objectionably high optical haze level, suggested by Notley as being due to the moderating influence of domains of a second resinous phase and do not approach the sensitivity levels of films prepared from pure methacrylonitrile homopolymer. These and other problems are overcome by the present invention which provides a vesicular photographic material whose vehicle is a methacrylonitrile homopolymer homogeneously blended with other resins to form a single phase. A number of these other resins, prior to the present invention, have been thought to be incompatible with polymers of methacrylonitrile.

SUMMARY OF THE INVENTION

The present invention comprises both a light-sensitive vesicular material and a process for its manufacture having a homogeneously blended polymeric matrix wherein a light-sensitive compound is dispersed. The matrix comprises a blend of polymethacrylonitrile homopolymer with another resin selected from the group consisting of vinyl polymers and copolymers; epoxy polymers; and copolymers with polyurethane segments. Vinyl polymers and copolymers are further defined as being selected from a group consisting of (a) polymers of vinyl chloride; polymers of vinylidene chloride; and their respective copolymers; (b) polymers of acrylonitrile; polymers of substituted acrylonitrile; and their respective copolymers; (c) polymers of styrene; polymers of substituted styrene; and their respective copolymers; and (d) polymers of vinyl alcohol derivatives and copolymers thereof. Polymeric blends of polymethacrylonitrile with a copolymer of vinylidene chloride and acrylonitrile are especially preferred. Also preferred are blends of polymethacrylonitrile and a copolymer of α-chloroacrylonitrile and methacrylonitrile.

Among the advantages and features of the present invention is the fact that, contrary to the assumption of the prior art, compatible mixtures incorporating the methacrylonitrile homopolymer as a modifier to the second polymeric resin can be achieved with common solvents. In this respect, compatibility is defined as the ability of the blend to form a clear, as distinguished from a hazy, film when a film is formed by evaporation of the solvent or mixture of solvents, from a solution of the film.

These compatible mixes form vesicular photographic materials having a single phase polymeric vehicle which possess photographic responses which are comparable to those found in pure polymethacrylonitrile film, even in embodiments in which the polymethacrylonitrile is present to an extent of less than 50%. Further, the blended photographic vehicles of the present invention exhibit the excellent craze resistant and adhesion characteristics of the preferred second polymers. Due presumably to the degree of homogeneity and lack of phase separation within the blended resinous vehicle, images resulting from the practice of the present invention show improved resolution of pictorial detail and a low level of background haze, as well as improved film speed and other enhanced photometrics. These and other features and advantages of the present invention will be evident from the following detailed description.

DESCRIPTION OF THE PREFERRED EMBODIMENTS

The present invention provides both a light-sensitive vesicular material and a process for its manufacture wherein the polymeric matrix of the material comprises a blend of polymethacrylonitrile homopolymer with another resin selected from the group consisting of vinyl polymers and copolymers; epoxy polymers; and copolymers with polyurethane segments. Within the polymeric vehicle is dispersed a photosensitive compound capable of decomposing to yield a gas upon exposure to actinic radiation. Pursuant to the process of the present invention, vesicular images are formed in the polymeric matrix by exposing the vesicular material to light to decompose the photosensitive compound which thereby forms a gas, followed by heating of the material to develop a vesicular image therein consisting of minute bubbles or vesicles.

Various homopolymers of methacrylonitrile may be used. However, it is preferable to use lower molecular weight polymers because they are compatible with the other polymers over a wider range of proportions. Thus it is preferred that the molecular weight of the methacrylonitrile is less than about 500,000. By gel permeation chromatography, particularly useful polymers have a weight average size of 1440 to 2450.

Vinyl polymers and copolymers thereof are especially preferred for use as the second component of the blends of the instant invention, particularly vinylidene chloride-acrylonitrile copolymers, especially those vinylidene chloride-acrylonitrile copolymers having between about 60 to about 90% by weight vinylidene chloride present, the balance consisting of acrylonitrile and other constituents normally present in a commercial preparation. These polymers are preferred for use in the instant invention because they are not only readily available and hence offer economic advantage but additionally exhibit physical properties whereby the distinct advantages of the present invention are maximized, especially with regard to an improvement in speed achieved by those vesicular materials in comparison with polymethacrylonitrile homopolymer vesicular material. As brought out above, the latter polymers are blended with polymethacrylonitrile in the present system and which is preferably present within about 10 to 40% by weight.

Another particularly preferred embodiment of the instant invention is a vesicular material comprising from about 50 to about 70% by weight methacrylonitrile and the balance, excluding normal impurities and additives, of a copolymer of from about 30 to about 50% by weight chloroacrylonitrile and the balance methacrylonitrile. It has been found that these polymeric materials also produce an enhanced vesicular medium prepared by way of the present invention.

As brought out above, vinyl polymers and copolymers thereof are especially preferred resins for use as the polymeric matrix of the present vesicular photographic films. Among the vinyl polymers and their copolymers are the polymers of vinyl chloride and vinylidene chloride and their respective copolymers, e.g., vinylidene chloride-acrylonitrile copolymers; poly vinyl chlorides; vinyl chloride-vinylidene chloride copolymers; vinyl chloride-vinyl acetate copolymer; vinyl chloride-vinyl alcohol copolymers; vinylidene chloride-methylacrylonitrile copolymers; and vinylidene chloride-methyl methacrylate copolymers.

By vinyl polymers and their copolymers is also meant polymers of acrylonitrile and substituted acrylonitriles, such as methylacrylonitrile and α-chloroacrylonitrile and their respective copolymers, exemplary of which are acrylonitrilemethyl acrylate copolymers; poly α-chloroacrylonitrile; methylacrylonitrile-α-chloroacrylonitrile copolymers; acrylonitrile-ethylacrylate copolymers; methylacrylonitrile-itaconic acid copolymers; methylacrylonitrile-diallyl maleate; and methylacrylonitrile-methacrylic acid.

The vinyl polymers and their copolymers also include polymers of styrene and substituted styrene such as α-methylstyrene and vinyl toluene and their respective copolymers, e.g., styrene-acrylonitrile copolymers; styrene-maleic anhydride copolymers; styrene-butadiene-acrylonitrile terpolymer; and styrene-methacrylonitrile copolymers.

Also included as vinyl polymers and copolymers are the polymers of vinyl alcohol derivatives, such as vinyl ethers, vinyl esters, and vinyl acetals and their respective copolymers, for example, poly(methyl vinyl ether-maleic anhydride) copolymers; poly(vinyl formals); poly(vinyl butyrals); and vinyl alcoholvinyl acetate copolymers.

Another suitable class of resins for use as the vehicle of the present vesicular films are epoxy resins. By epoxy resin is meant any polymeric material formed by the polymerization of a monomer having an oxirane ring with a monomer having a di-hydroxyl structure. Epoxy resins are generally marketed in the form of various combinations of these basic monomers, that is, polymers thereof, and in an uncured state. Exemplary of various uncured epoxy reins, or monomers, that can be employed as the vehicle in the present invention are: diglycidyl isophthalate; diglycidyl phthalate; o-glycidyl phenyl glycidyl ether; diglycidyl ether of resorcinol; triglycidyl ether of phloroglucinol; triglycidyl ether of methyl phloroglucinol; 2,6-phenylglycidyl ether; triglycidyl p-aminophenol; diglycidyl ether of bisphenol-A; diglycidyl ether of bisphenol-hexafluoroacetone; diglycidyl phenyl ether; diglycidyl ether of tetrachlorobisphenol-A; triglycidyl ether of trihydroxybiphenyl; tetraglycidyl ether of bisresorcinol-F; tetraglycidoxy tetraphenylethane; polyglycidyl ether of phenol-formaldehyde novolac; diglycidyl ether of butanediol; triglycidyl ether of glycerol; diglycidyl ether of dioxanediol; vinylcyclohexene dioxide; dicycloaliphatic diether diepoxy, and the like.

Another suitable class of polymers for use as a vehicle in the present invention are copolymers with polyurethane segments. Such compounds are generally defined as those polymers having a segmented or block structure comprising segments containing regular repeating groups linked to polymeric segments of another type. Copolymers with polyurethane segments are generally obtained by reacting a diisocyanate, e.g., 2,4-tolylene diisocyanate; 4,4-diphenylmethane diisocyanate; 1,2-ethane diisocyanate; and the like, with a combination of hydroxyl containing polymer and low molecular weight diol, e.g., ethylene glycol; trimethylene glycol; diethylene glycol; and the like. Thus, suitable copolymer systems may contain any of the before mentioned polymers, preferably, however, methacrylonitrile and copolymers thereof, linked together by polyurethane segments as formed in the conventional manner well known in the art.

In accordance with one aspect of the present invention, it has been found that the physical properties of the blends and their adhesion to a polyester film base can be improved by blending them with a compatible polyester in amount up to about 20%, or a small quantity of an acrylic rubber.

EXAMPLES 1-10

In the following examples, film samples were made by first preparing the blended polymeric coating composition as shown in the table below by preferably simultaneously dissolving both the polymethacrylonitrile homopolymer and the respective second polymer in a solution of the solvents shown. However, the polymeric materials can be separately dissolved in the solvents shown and thereafter blended by combining the separate solutions. The sensitizer was then preferably dissolved in the solvent shown and the sensitizer solution thereafter added to the blended polymeric solution, with the exception of Example 3 wherein the sensitizer salt was added to the blended polymeric solution as a solid.

The resulting coating composition was then coated onto a polyethyleneterephthalate film base with sufficient solution to produce a dry thickness of approximately 0.4 mil in the various examples. The samples were then dried, that is, the solvents contained therein were evaporated, by milding heating at 150° F. for about 5 minutes and then cured at 240° F. for about 10 minutes. The films also may be treated by the process of U.S. Pat. No. 3,149,971.

The following table wherein all parts are by weight is a tabulation of the various materials employed in making the respective samples pursuant to the above procedure.

| Ex. No. | Parts of Polymeth-acrylo-nitrile | Other Resin | Parts of Other Resin | Resin Solvents*** | Sensitizer Solvents*** | Sensitizer** |
|---|---|---|---|---|---|---|
| 1 | 10 | vinylidene chloride-acrylonitrile (75/25)* copolymer | 90 | 200-methylethyl ketone<br>100-tetrahydrofuran<br>40-1,4 dioxane<br>20-acetonitrile<br>40-acetone | 60-acetonitrile | 10 - 2,5-diethoxy-p-morpholino-benzene diazoni-tetrafluorobora |
| 2 | 20 | vinylidene chloride-acrylonitrile (80/20)* copolymer | 80 | 100-methylethyl ketone<br>100-tetrahydrofuran | 50-acetonitrile | SAME AS EX. NO. 1 |
| 3 | 20 | vinylidene chloride-acrylonitrile (75/25)* copolymer | 80 | 300-methylethyl-ketone<br>100-acetonitrile | NONE | SAME AS EX. NO. 1 |
| 4 | 30 | vinylidene chloride-acrylonitrile (75/25)* copolymer | 80 | 160-methylethyl ketone<br>100-tetrahydrofuran<br>40-1,4 dioxane<br>30-acetonitrile<br>40-acetone | 50-acetonitrile | SAME AS EX. NO. 1 |
| 5 | 40 | vinylidene chloride-acrylonitrile (75/25)* copolymer | 60 | 90-methylethyl ketone<br>150-tetrahydrofuran<br>80-1,3 dioxolane<br>60-acetonitrile | 40-methylethyl ketone<br>45-methanol | SAME AS EX. NO. 1 |
| 6 | 50 | vinylidene chloride-acrylonitrile (75/25)* copolymer | 50 | 80-methylethyl ketone<br>80-tetrahydrofuran<br>20-1,4 dioxane<br>40-acetonitrile<br>40-acetone | 40-acetonitrile | SAME AS EX. NO. 1 |

*Designates proportions of vinylidene chloride and acrylonitrile respectively
***Numbers give parts by weight of solvent and sensitizer

| Ex. No. | Parts of Polymeth-acrylo-nitrile | Other Resin | Parts of Other Resin | Resin Solvents*** | Sensitizer Solvents*** | Sensitizer*** |
|---|---|---|---|---|---|---|
| 7 | 30 | α-chloroacrylonitrile-methacrylonitrile (40/60)** copolymer | 70 | 250-acetonitrile<br>50-acetone<br>25-methylethyl ketone | 50-acetonitrile | SAME AS EX. NO. 1 |
| 8 | 40 | α-chloroacrylonitrile- | 60 | 200-acetonitrile | 50-acetonitrile | SAME AS EX. NO. 1 |

-continued

| | | | | | | |
|---|---|---|---|---|---|---|
| | | methacrylonitrile (40/60)** copolymer | | 50-acetone 25-methylethyl ketone | | |
| 9 | 50 | α-chloroacrylonitrile-methacrylonitrile (40/60)** copolymer | 50 | 150-acetonitrile 50-acetone 25-methylethyl ketone | 50-acetonitrile | SAME AS EX. NO. 1 |
| 10 | 60 | α-chloroacrylonitrile-methacrylonitrile (40/60)** copolymer | 40 | 120-acetonitrile 48-acetone 48-methylethyl ketone | 48-acetonitrile 24-methanol | SAME AS EX. NO. 1 |
| 11 | 23 | acrylonitrile-methacrylonitrile (60/40)** copolymer | 77 | 246-acetonitrile | 19-acetonitrile 19-methanol | SAME AS EX. NO. 1 |
| 12 | 50 | acrylonitrile-methacrylonitrile (60/40)** copolymer | 50 | 225-acetonitrile | 100-acetonitrile 25-methanol | SAME AS EX. NO. 1 |
| 13 | 43 | hydroxy ethyl methacrylate-methacrylonitrile (4/96)**-polyurethane (70/30)** copolymer | 57 | 129-acetonitrile | 43-acetonitrile | 14.3 of above sensitizer |
| 14 | 51.7 | hydroxy ethyl methacrylate methacrylonitrile (4/96)**-polyurethane (70/30)** copolymer | 29.0 | 168-acetonitrile | 29-acetonitrile | 12.9 of above sensitizer |
| | | poly alpha-chloroacrylonitrile | 19.3 | | | |

**Designates proportions of monomers in order listed
***Numbers listed give parts by weight of solvents and sensitizers

EXAMPLE 15

20 parts of polymethacrylonitrile was blended with 80 parts of poly (methyl vinyl ether-maleic anhydride copolymer) (Gantrez AN-119-trademark GAF) in a solution of 460 parts 1,3-dioxolane. To this solution was added the sensitizer solution comprising 10 parts sensitizer of example 1 above dissolved in 20 parts acetonitrile and 20 parts methanol. A similar enhanced vesicular film was realized.

EXAMPLE 16

In this example, 50 parts of polymethacrylonitrile was blended with 50 parts of poly α-chloroacrylonitrile in a solution of 460 parts acetonitrile. The sensitizer was added in the form of solution comprising 10 parts of the sensitizer employed in example 1 above first dissolved in 40 parts acetonitrile. Similar results were obtained.

EXAMPLE 17

20 parts of polymethacrylonitrile in this example was blended with 80 parts of styrene-maleic anhydride copolymer (SMA-4000 A-trademark Sinclair) in 440 parts of acetonitrile as the solvent. The sensitizer of example 1 above is added by dissolving 10 parts thereof and 40 parts of acetonitrile and this solution is added to the blended resin solution. A vesicular film with similar enhanced photometric properties is realized.

EXAMPLE 18

The coating composition in this example was made by blending together 50 parts polymethacrylonitrile and 50 parts of a diglycidyl ether of bisphenol A type epoxy resin, epoxy equivalent weight 4000–6000, Durran's m.p. 155°–165° C., made by reaction of epichlorohydrin with bisphenol-A, identified as Epon 1010 (trademark-Shell) dissolved in 117 parts methyl ethyl ketone and 75 parts 1,3 dioxolane. To this is added a solution comprising 50 parts methyl ethyl ketone in which 10 parts of the sensitizer as employed in examples 1–10 above is dissolved.

The resulting coating composition is then coated onto a polyethyleneterephthalate film base with sufficient solution to produce a dry thickness of 0.5 mil. The sample is then dried and cured as described in the above examples. Accordingly, similar advantages of a film thus produced are realized.

EXAMPLE 19

Following the procedure of example 7 above, when a resin blend of 30 parts of polymethacrylonitrile and 70 parts of α-chloroacrylonitrile-methacrylonitrile (20/80) copolymer is employed, also employing the same sensitizer and solvents, similar results are obtained.

EXAMPLE 20

Following the procedure of example 8 above, when a resin blend of 40 parts of polymethacrylonitrile and 60 parts of α-chloroacrylonitrile-methacrylonitrile (60/40) copolymer is employed, also employing the same sensitizer and solvents, similar results are obtained.

EXAMPLE 21

Following the procedure of example 9 above, when a resin blend of 50 parts of polymethacrylonitrile and 50 parts of α-chloroacrylonitrile-methacrylonitrile (80/20) copolymer is employed, also employing the same sensitizer and solvents, similar results are obtained.

EXAMPLE 22

Following the procedure of the above examples, 40 parts of polymethacrylonitrile is blended with 60 parts of isobutyl acrylate-methacrylonitrile (50/50) in acetonitrile as a common solvent. To this solution is added a sensitizer solution comprising 50 parts acetonitrile and 10 parts paradimethylaminobenzene diazonium chloride (zinc chloride double salt). Similar beneficial results are obtained.

EXAMPLE 23

In this example 50 parts of polymethacrylonitrile is blended in acetone with 50 parts hexafluoroisopropylacrylatemethacrylonitrile (70/30). 10 parts of the sensitizer employed in example 22 above is then dissolved in acetonitrile and is then added to the blended resin solution. A film of enhanced photometric properties is also realized.

Similar substitution of the various polymeric materials listed above and blended with methylacrylonitrile following the procedures of the above working examples, also yields films of superior photometric properties.

Among the advantages and features of the present invention is the realization of increased film speed. For example, in comparison of the present blended Saran/-polymethacrylonitrile films with that of polymethacrylonitrile film, a film speed increase of ⅔ rds. of a stop is realized as shown in the table below. Similar improvements are realized for the other blended films of the present invention.

| Term | Polymethacrylonitrile | Saran/polymeth-acrylonitrile |
|---|---|---|
| Dmax | 2.50 | 2.64 |
| Dmin | 0.17 | 0.20 |
| Sn 0.6 speed above background | 1.76 | 1.94 |

The above data was obtained from projection f/4.5 densitometry.

It is to be understood that the various physical characteristics of the polymeric materials employed in the present blended vesicular film system can be varied as desired by the addition of modifiers. Moreover, various materials can be added for the preservation of the sensitizer compound employed, e.g., various acids as taught in the art. Moreover, other materials, such as dyes and other compounds, can be added to improve the photometrics of a particular film without departing from the true scope and spirit of the present invention.

Where a support is employed on which the present vesicular photographic material is overcoated, the support can be any suitable material which is compatible with the medium, e.g. glass, polymeric materials, paper and the like. By compatibility with the photographic medium, it is meant that the support must be free from materials which will not degradate the emulsion overlay, e.g. due to the bleeding of constituents, such as plasticizers, from the polymeric support upon contact with the coating which may contain solvents that would initiate such phenomena. Of course, where the particular physical and/or chemical properties of a support are critical for a given application, this problem may be resolved by treating the support with an intermediate layer or coating which forms a suitable barrier. For photographic applications, a polyethylene terephthalate base material is preferred since it has excellent chemical and physical stability under standard processing conditions and it has excellent dimensional stability. As is well known in the art, where a transparent support is employed a vesicular image recorded thereon in the conventional manner produces a corresponding image having the opposite photographic sign. However, the use of an opaque support, e.g. a black support, will produce a photographic image having the same photographic sign.

The vehicle and the sensitizer may be combined by any suitable method. However, it is preferred that they each be dissolved in a solvent and the resultant solutions combined. In this embodiment it is only necessary that the respective solutions be mutually miscible. For the most part, solvents such as alcohols, ketones, nitriles, esters, ethers and halogenated solvents may be used. Particularly useful are methyl, ethyl and isopropyl alcohols, alkyl acetates, acetone, methyl ethyl ketone, dioxane and acetonitrile. However, any inert solvent which meets the above miscibility requirement may be used.

After the film is thus prepared, there are at least three different methods of processing it. In one form, the film is exposed to image forming light, e.g., by being placed in contact with a transparency and exposed to light passing through the transparency, then the film is heated to 160°-500° F., for 1/1000 to 3 seconds. This will produce an image of the opposite photographic sign from the transparency. Thus, if the transparency is negative, a positive vesicular photograph will result.

A second processing system which can be used is that described in U.S. Pat. No. 2,911,299. In it, the film is exposed to image forming light and gas released by the sensitizer is allowed to diffuse from the vehicle at a temperature too low for development to take place. Then the film is exposed overall to uniform light which actuates non-decomposed sensitizer, and it is heated to cause development at 160°-500° F. for 1/1000 to 3 seconds either during or shortly after the second exposure, but before the gas has substantially diffused from the film. This results in image formation in areas not originally struck by light and an image of the same photographic sign as the transparency. Thus, a negative transparency results in the formation of a negative vesicular photograph which might be called a reversal image or a direct image.

The third processing system is that decribed in U.S. Pat. No. 3,457,071. In that system, the film is exposed to image forming light of relatively low intensity for at least about 0.5 second and preferably for at least about 2.0 seconds. That is, the light is of low enough intensity that the film does not receive a normal exposure in less than 0.5 second and preferably 2.0 seconds. Then the film receives an overall exposure of light intensity which is sufficient to expose the film in less than 0.2 second and preferably less than 0.01 second. Overexposure or longer exposure can be tolerated, but there must be sufficient light to properly expose the film during the indicated time. This procedure avoids a separate diffusion step as used in the method of U.S. Pat. No. 2,911,299. In some cases, no heating is required to cause development, and the image appears spontaneously. However, in other cases, some heating may be used to advantage, as more fully described in U.S. Pat. No. 3,457,071.

What is claimed is:

1. In a light-sensitive vesicular material comprising a thermoplastic resin vehicle coated onto a polyethylene terephthalate backing in which is dispersed a photosensitive compound which is capable of decomposing to yield nitrogen gas when exposed to actinic radiation, said vehicle consisting of a blended polymer admixture of a homopolymer of methacrylonitrile and a copolymer of vinylidene chloride and acrylonitrile having 60-90% by weight vinylidene chloride which is compatible with said homopolymer of methacrylonitrile wherein the amount of said copolymer is greater than 50% by weight of the total weight of the blended polymers.

2. A light-sensitive vesicular material as set forth in claim 1 wherein said methacrylonitrile homopolymer has a molecular weight below 500,000.

* * * * *